US007051444B1

(12) United States Patent
Hofer

(10) Patent No.: US 7,051,444 B1
(45) Date of Patent: May 30, 2006

(54) MEASURING AND MARKING APPARATUS FOR FIREWOOD

(76) Inventor: Benny A. Hofer, County Rd. 30, HCR 85, Box 104, Bonners Ferry, ID (US) 83805

( * ) Notice: Subject to any disclaimer, the term of this patent is extended or adjusted under 35 U.S.C. 154(b) by 0 days.

(21) Appl. No.: 11/102,918

(22) Filed: Apr. 11, 2005

(51) Int. Cl.
*B05B 1/28* (2006.01)

(52) U.S. Cl. ..... 33/39.1; 33/37; 239/150

(58) Field of Classification Search ..... 33/37–38, 33/39.1, 39.2, 775, 779, 780–782, 759–762
See application file for complete search history.

(56) References Cited

U.S. PATENT DOCUMENTS 3,577,918 A * 5/1971 Wayfield ..... 33/782
4,545,531 A * 10/1985 Williams ..... 239/150
4,895,304 A * 1/1990 Smrt ..... 239/150
5,749,522 A * 5/1998 Smrt ..... 239/71
5,785,214 A * 7/1998 Smrt ..... 239/150
6,102,305 A * 8/2000 Chapman et al. ..... 239/150
6,390,336 B1 * 5/2002 Orozco ..... 239/150
6,698,774 B1 * 3/2004 Duncan ..... 239/147
2002/0175221 A1 * 11/2002 Roman ..... 239/150

* cited by examiner

*Primary Examiner*—Yaritza Guadalupe McCall
(74) *Attorney, Agent, or Firm*—Keith S. Bergman; William A. Jeckle

(57) ABSTRACT

A measuring and marking apparatus for firewood includes an upstanding tubular body having a handle, defining a channel to carry an inverted aerosol can of marking material and journaling a measuring wheel having a circumferential length equal to a desired length of firewood. The measuring wheel is journaled between wheel forks carried by and extending from the lower body portion. A protruding dog carried on a face of the measuring wheel engages an actuator carried by the body and communicating with the nozzle of the aerosol can so that each rotation of the measuring wheel causes a dispersal of marking material onto the surface being measured and marked.

6 Claims, 3 Drawing Sheets

MEASURING AND MARKING APPARATUS FOR FIREWOOD

BACKGROUND OF INVENTION

1. Related Applications

There are no applications related hereto heretofore filed in this or in any foreign country.

2. Field of Invention

This invention relates to measuring and marking apparatus, and more particularly to apparatus that measures and marks logs for cutting into firewood of uniform lengths.

BACKGROUND AND DESCRIPTION OF PRIOR ART

Use of wood burning stoves and fireplaces is again becoming more common in the modern day for domestic heating as the population seeks additional and alternative sources of heating fuel. As use of wood burning stoves and fireplaces increases, so does the demand for firewood.

Domestic wood burning stoves and fireplaces commonly have fire boxes that are designed and engineered to use specific lengths of firewood and efficient operation such devices is dependent upon consistent lengths of firewood fuel. Common firewood lengths for domestic use are 6, 12, 14, 16, 18, 20 or 24 inches. Lengths in excess of such standards will generally not fit through stove doors nor lie flat on a fire box rack. Lengths shorter than the design standards waste fire box space leading to inefficient operation and loss of heat generating capacity. Consistent lengths also make stacking and storage of firewood easier and safer.

A common method of measuring firewood into uniform lengths in preparation for cutting has been to use a stick having a desired length and a hatchet. The stick is placed on a log to be cut and the hatchet is used to score the log immediately adjacent one end of the stick. Thereafter, the stick is repositioned at the score mark and the process is repeated along the length of log being measured and marked. Such process is time-consuming because the stick must be repeatedly positioned, and dangerous because a hatchet is used to create the measurement mark. Various other methods to measure and mark lengths of firewood are known, but such other methods have similar disadvantages of time consumption, dangerousness and inefficiency of movement.

The instant invention seeks to resolve such disadvantages inherent in known firewood measuring and marking apparatus by using a body having rotatable measuring wheel with a circumference equal to the desired length of firewood. The measuring wheel communicates with an aerosol can of marking material carried by the body by means of an actuator which intermittently causes discharges marking material responsive to wheel rotation to make uniformly spaced marks along the length of the log. The wheel may be easily interchanged to measure and mark different lengths of firewood.

My invention does not reside in any of the foregoing features individually but rather in the synergistic combination of all of its structures, which necessarily give rise to the functions flowing therefrom as herein specified and claimed.

My measuring and marking apparatus for firewood provides an elongate upstanding tubular body carrying a handle and journaling a rotatable measuring wheel having an effective circumference equal to a desired length of firewood. The body defines two diametrically opposed actuator slots spacedly adjacent the lower end to carry an actuator communicating with dispersing nozzle of an aerosol can of marking material carried in medial channel defined by body. The measuring wheel rotates on a bolt type axle journaled by wheel forks carried by body to extend therefrom adjacent one actuator slot and opposite the handle. Plural cleats optionally may extend radially from the circumferential surface of the wheel to enhance engagement between the wheel and a log surface being measured and marked. A dog carried on a face surface of the wheel communicates with the actuator carried in actuator slots on each rotation of wheel to cause dispersal of marking material onto surface being measured for marking the distance between marks is equal to the effective circumference of the measuring wheel.

In providing such an apparatus it is:

A principal object to provide an improved apparatus for measuring and marking uniform lengths of firewood that is simple to use.

A further object is to provide such apparatus that may have interchangeable measuring wheels of differing circumferential length to create marks having different spacing intervals.

A further object is to provide such apparatus that uses aerosol marketing material contained in standard marketing containers.

A still further object is to provide such apparatus that is of new and novel design, of a rugged and durable nature, of simple and economic manufacture and use and one that is otherwise well suited to the uses and purposes for which it is intended.

Other and further objects of my invention will appear from the following specification and accompanying drawings which form a part hereof. In carrying out the objects of my invention it is to be understood that its features are susceptible to change in design and structural arrangement with only one preferred and practical embodiment of the best known mode being illustrated in the accompanying drawings and specified, as is required.

BRIEF DESCRIPTIONS OF DRAWINGS

In the accompanying drawings which form a part hereof and wherein like numbers of references refer to similar parts throughout:

DESCRIPTION OF PREFERRED EMBODIMENT

As used herein, the term "bottom", its derivatives, and grammatical equivalents refers to that portion of the apparatus closest to the material being marked when measuring and marking apparatus for firewood is in use. The term "top", its derivatives, and grammatical equivalents refers to that portion of the apparatus furthest from the material being marked when measuring and marking apparatus for firewood is in use.

Figure 1:
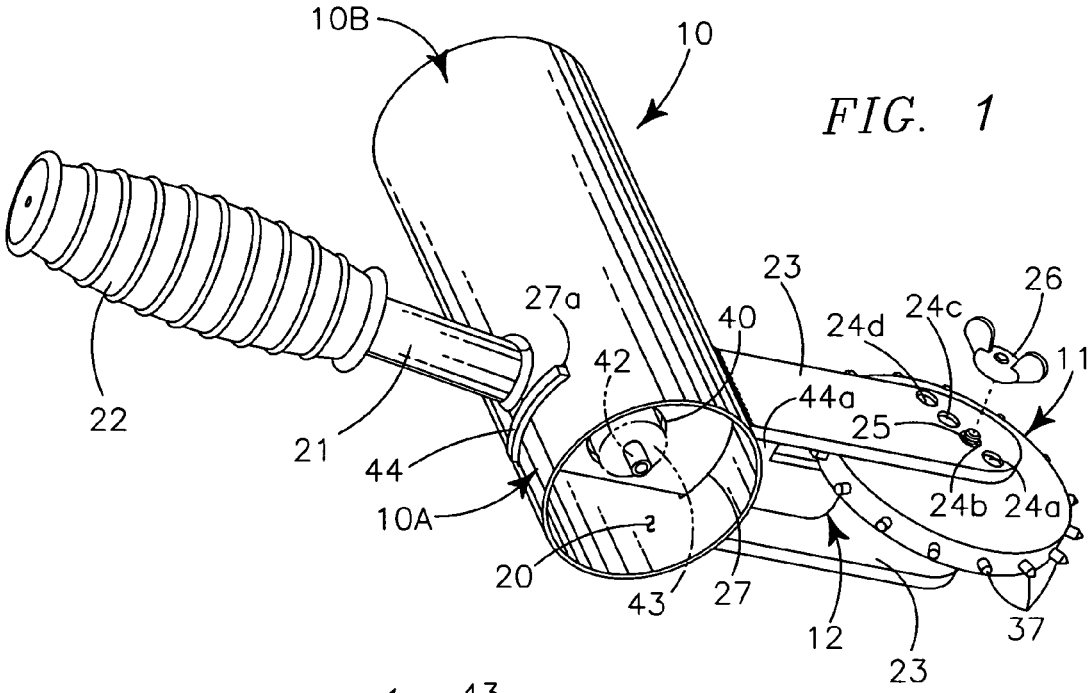
FIG. 1 is an upward looking right side and bottom isometric view of my measuring and marking apparatus for firewood.
Figure 2:
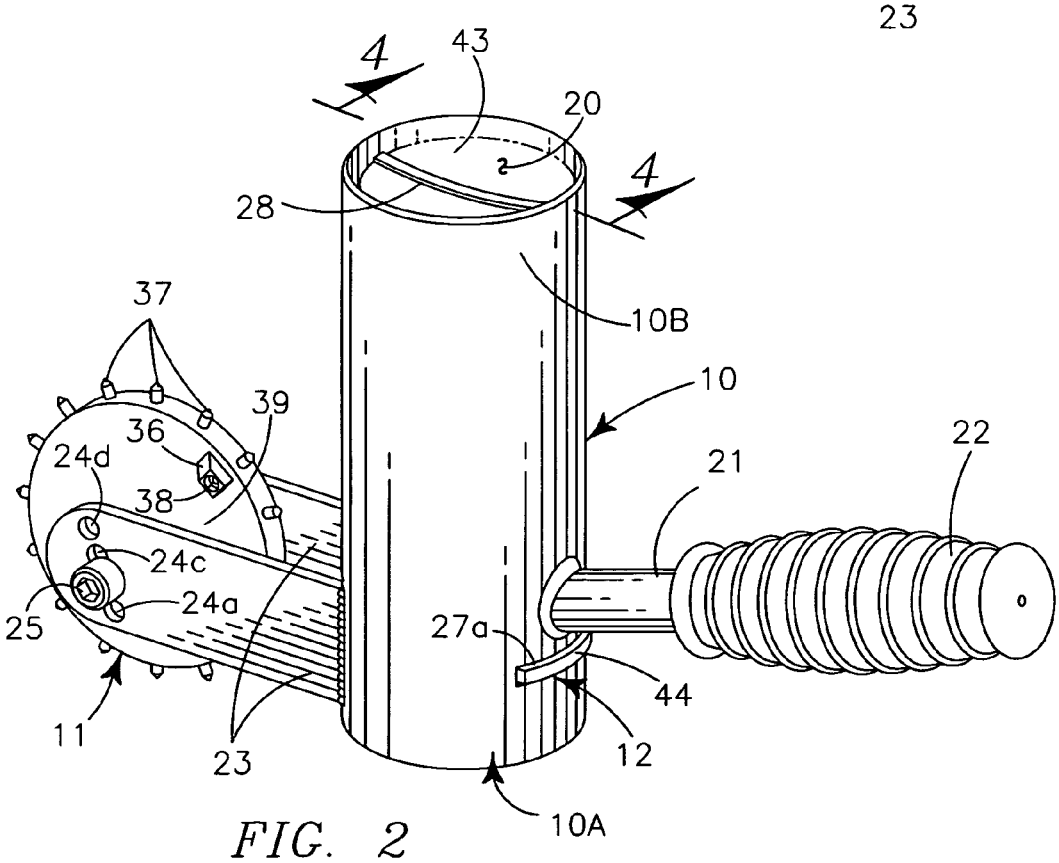
FIG. 2 is a forward looking isometric top and left side view of the apparatus of FIG. 1.

Referring to the drawings, and more particularly to FIG. 1, my measuring and marking apparatus for firewood generally comprises elongate upstanding tubular body 10 carrying rotatable measuring wheel 11 and actuator 12 communicating between body 10 and measuring wheel 11.

Body 10 has a bottom portion 10*a* and opposing top portion 10*b* that define medial channel 20 extending therethrough. Medial channel 20 is sized and configured to carry an inverted axially aligned aerosol can 43 of marking material 50 of standardized commercial configuration. Two opposing actuator slots 27 are defined in body 10 spacedly adjacent bottom end 10*a* to carry actuator 12 extending therethrough and therebetween. Handle 21 carrying handgrip 22 in its outer end is structurally carried on the lower medial outer circumference of body 10 to provide means for operator manipulability to grasp and maneuver apparatus. Handle 21 is positioned spacedly adjacent and above first actuator slot 27*a*, and may be angulated upwardly to improve ergonomics.

Wheel forks 23 are structurally carried by and extend generally perpendicularly from body 10 adjacent both ends of second actuator slot 27 diametrically opposite handle 21. Plural pairs of spacedly aligned axle holes 24*a*, 24*b*, 24*c*, 24*d* are defined in end portions of each wheel fork 23 opposite body 10 to journal bolt type axle 25 to rotatably carry measuring wheel 11. Positioning of axle holes 24*a*, 24*b*, 24*c*, 24*d* in wheel forks 23 aids use of measuring wheel 11 having varying circumferential lengths, commonly 6, 12, 14, 16, 18, 20 and 24 inches respectively which correspond to common lengths of firewood. Axle nut 26 secures axle 25 in position and is preferably a "wing-nut" to allow simple interchangeability of measuring wheel 11.

Retainer 28 formed of a strip of spring steel is sized to extend diametrically across and frictionally engage with opposing inner circumferential surfaces of body 10 defining medial channel 20 to secure aerosol can 43 in medial channel 20 and prevent upward axial movement of the aerosol can 43 in the channel 20.

Measuring wheel 111 defines a center axle hole 35 to carry bolt type axle 25 between wheel forks 23 and plural radially extending cleats 37 on the circumferential surface to enhance engagement with a surface being measured and marked. A protruding dog 36 is fastened to face surface 39 of measuring wheel 11 by releasable fastener 38.

Figure 3:
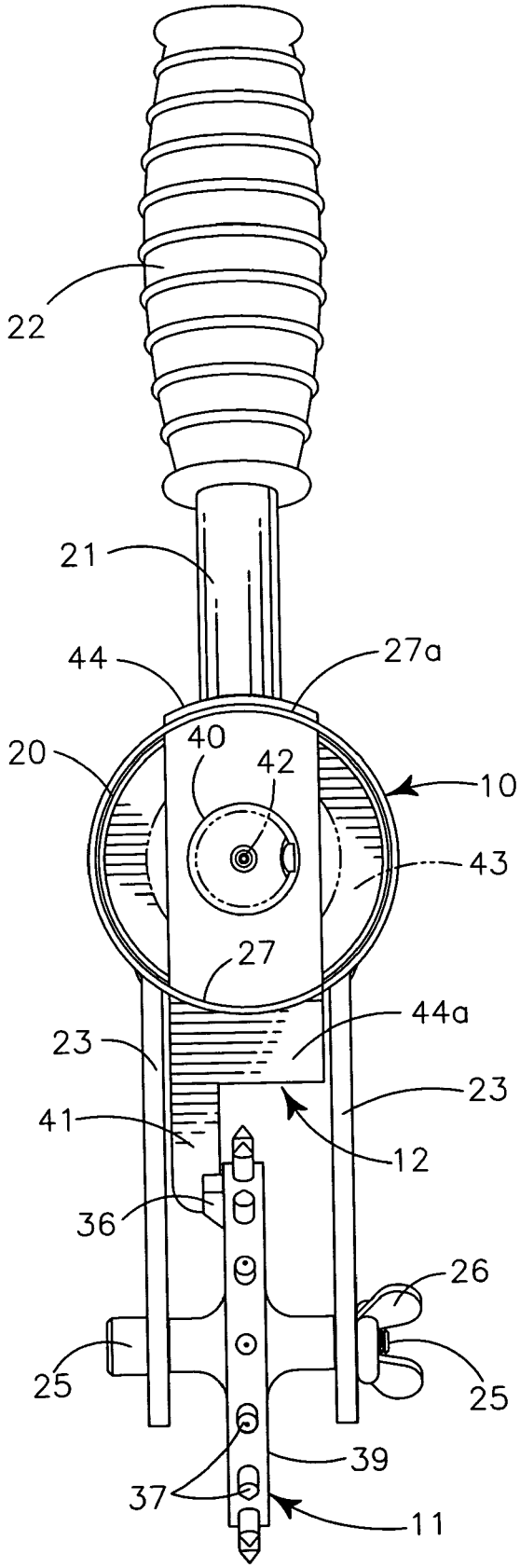
FIG. 3 is an orthographic bottom view of the instant invention.
Figure 5:
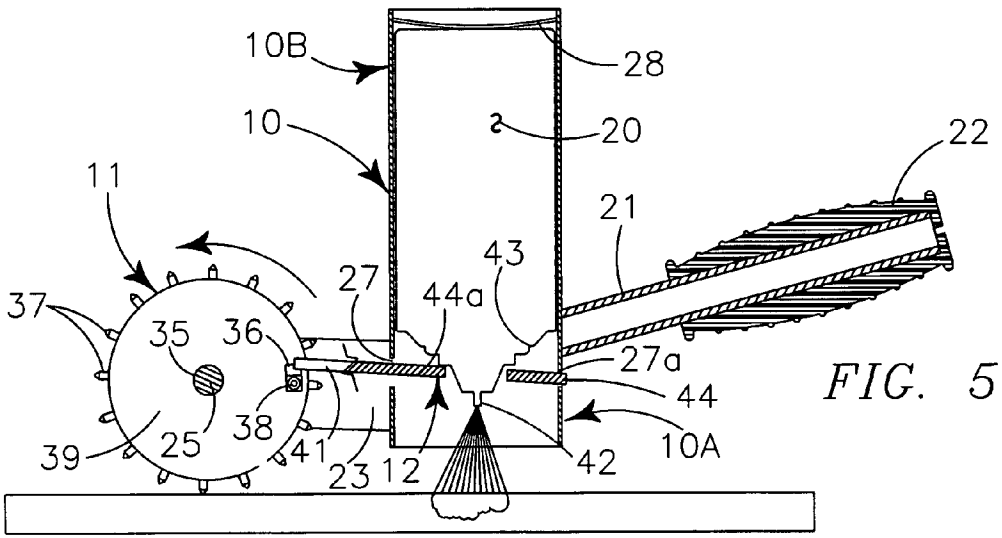
FIG. 5 is a medial cross-sectional view similar to that of FIG. 4, but showing the apparatus having measured a length of firewood and discharging marking material.

As shown in FIG. 3, actuator 12 is an elongate member defining nozzle hole 40 spacedly adjacent first end portion 44 and elongate leg 41 at second opposing end portion 44*a*. Actuator 12 is carried in actuator slots 27 and extends through and diametrically across medial channel 20 with elongate leg 41 extending outwardly between wheel forks 23. Actuator 12 supports nozzle end portion of aerosol can 43 in medial channel 20 with dispersing nozzle 42 of aerosol can 43 carried in nozzle hole 40. Elongate leg 41 extends adjacent face surface 39 of measuring wheel 11 between wheel forks 23 to engage with protruding dog 36 upon each rotation of measuring wheel 11. Engagement of elongate leg 41 with protruding dog 36 causes actuator 12 to move vertically angularly within actuator slots 27. Because dispensing nozzle 42 is carried within nozzle hole 40, movement of actuator 12 displaces disbursement nozzle 42 to cause marking material to be discharged from aerosol can 43 onto the surface being measured and marked as shown in FIG. 5. Accordingly, manually maneuvering the apparatus along the length of a log causes measuring wheel 11 to rotate repeatedly which responsively causes discharges of marking material onto the log at uniformly spaced points. Each mark provides a visually identifiable cut location for subsequent cutting.

Having described the structure of my measuring and marking apparatus for firewood, its assembly and operation may be understood.

A measuring wheel 11 having a circumferential length equal to a desired length of firewood is installed on the apparatus by positioning measuring wheel 11 between wheel forks 23 and inserting bolt type axle 25 through an opposed pair of axle holes 24*a*, 24*b*, 24*c* or 24*d* defined in wheel forks 23 corresponding to the length of the circumference of measuring wheel 11. Axle 25 is secured in position by axle nut 26. Actuator 12 is installed to extend through and between opposing actuator slots 27,27*a* defined in body 10 and is oriented so that elongate leg 41 extends adjacent face surface 39 of measuring wheel 11 carrying protruding dog 36. Aerosol can 43 of marking material is inserted into medial channel 20 with the dispersing nozzle 42 oriented downwardly so it is carried in nozzle hole 40 defined in actuator 12. Retainer 28 is installed at the upper end of medial channel 20 such that it frictionally communicates with opposing inner circumferential surfaces of body 10 defining medial channel 20 to prevent upward axial movement of the aerosol can 43 within channel 20.

Figure 4:
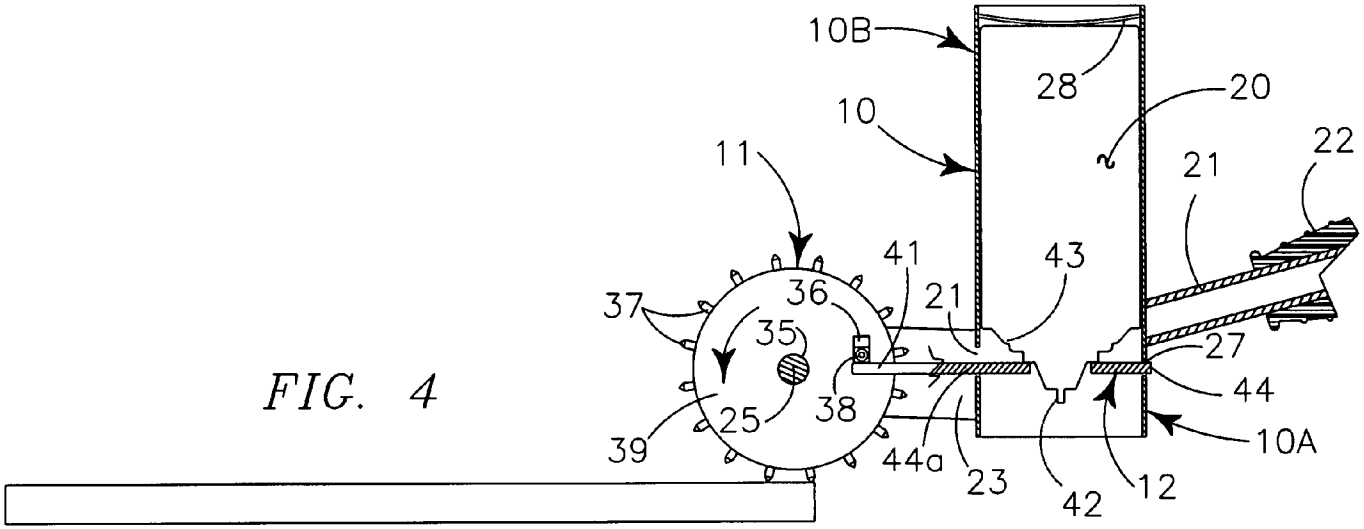
FIG. 4 is a medial cross-sectional view of the apparatus of FIG. 2, taken on the line 4—4 thereon, in a position to begin measuring and marking an elongate firewood element.

As is shown in FIG. 4, measuring wheel 11 is rotated so that protruding dog 36 is immediately adjacent and above elongate leg 41. The apparatus is then positioned so that measuring wheel 11 is vertically above at an end of the material to be marked. As the apparatus is moved forwardly by an operator as shown in FIG. 5, measuring wheel 11 rotates and at the end of each rotation protruding dog 36 engages elongate leg 41 of actuator 12 to responsively cause dispersion of marking material onto surface being measured and marked. When marking is completed, the operator may tighten axle nut 26 to prevent unintentional rotation of measuring wheel 11 that would result in possible unintentional discharge of marking material.

The foregoing description of my invention is necessarily of a detailed nature so that a specific embodiment of its best mode may be set forth as is required, but it is to be understood that various modifications of details, and rearrangement, substitution and multiplication of parts may be resorted to without departing from its spirit, essence or scope.

Having thusly described my invention, what I desire to protect by Letters Patent, and

I claim:

1. A measuring and marking apparatus to aid cutting of firewood, comprising in combination:

an upstanding tubular body having a medial channel to carry an inverted aerosol can containing marking material, retaining means to prevent the aerosol can from moving axially upward within the medial channel, a handle to aid manual manipulation, and two diametrically opposed slots spacedly adjacent a bottom portion of the body to carry actuator means;

a measuring wheel journaled in wheel forks carried by the body to extend spacedly adjacent therefrom at a first diametrically opposed slot, said measuring wheel having a protruding dog extending from a face surface, the protruding dog positioned to communicate with actuator means carried by body as the measuring wheel rotates, and adjustable friction means to bias wheel rotation; and actuator means carried in the opposed slots defined in the body, said actuator means defining a hole spacedly adjacent a first end portion to carry dispensing nozzle of an inverted aerosol can and an elongate leg at an opposing second end portion to extend adjacent the face surface of the measuring wheel to engage the protruding dog as measuring wheel rotates.

2. The measuring and marking apparatus of claim 1 wherein the aerosol can retaining means is a piece of spring steel removably carried in and extending diametrically across medial channel.

3. The measuring and marking apparatus of claim 1 wherein the aerosol can of marking material is an aerosol can of paint.

4. The measuring and marking apparatus of claim 1 wherein the circumferential surface of measuring wheel carries a plurality of radially extending cleats to engage a surface being measured and marked to prevent slippage between the measuring wheel and surface being measured and marked.

5. The measuring and marking apparatus of claim 1 wherein the face of the measuring wheel carries more than one protruding dogs.

6. A measuring and marking apparatus to aid cutting of firewood, comprising in combination:

an elongate upstanding tubular body, said body defining a lower end portion, an opposed upper end portion and a medial channel to carry an aerosol can of marking material, aerosol can retaining means formed of resilient spring steel removably carried in and extending diametrically across the medial channel to restrain an aerosol can from moving axially upward within the medial channel, a handle to aid operator manipulation of the body, and two diametrically opposing slots defined in body spacedly adjacent lower end portion to carry actuator means;

wheel forks structurally carried by the body, said wheel forks defining a plurality of cooperating opposed pairs of horizontally and vertically spaced arranged holes in outer end portions opposite the body to journal an axle;

a wheel carried on the axle journaled by measuring wheel forks, said measuring wheel having at least one protruding dog fastened to a face surface of measuring wheel to communicate with actuator means as the measuring wheel rotates, and a plurality of cleats extending radially from the circumferential surface of the measuring wheel; and an actuator means carried in the two diametrically opposed slots defining in the body, said actuator means defining a hole adjacent a first end portion to the carry nozzle of an inverted aerosol can and support the can against downward displacement and an elongate leg at a second opposing end portion to extend along face surface of measuring wheel to engage with dog as wheel rotates to activate dispersement from the aerosol can.

* * * * *